US006751425B2

(12) United States Patent
Fujimori et al.

(10) Patent No.: US 6,751,425 B2
(45) Date of Patent: Jun. 15, 2004

(54) IMAGE FORMING APPARATUS, CONTROL METHOD AND PROGRAM FOR THE IMAGE FORMING APPARATUS, AND STORAGE MEDIUM

(75) Inventors: Takashi Fujimori, Ibaraki (JP); Eiichi Motoyama, Tokyo (JP); Shokyo Koh, Ibaraki (JP); Mitsuhiko Sato, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/295,853

(22) Filed: Nov. 18, 2002

(65) Prior Publication Data

US 2003/0095807 A1 May 22, 2003

(30) Foreign Application Priority Data

Nov. 22, 2001 (JP) ..... 2001-356826

(51) Int. Cl.[7] ..... G03G 15/20
(52) U.S. Cl. ..... 399/69; 399/82
(58) Field of Search ..... 399/67, 69, 82, 399/320, 85; 219/216; 430/124, 126

(56) References Cited

U.S. PATENT DOCUMENTS

| | | | | |
|---|---|---|---|---|
| 5,043,763 A | | 8/1991 | Koh et al. | 355/206 |
| 5,118,920 A | | 6/1992 | Tanabe et al. | 219/216 |
| 5,179,263 A | | 1/1993 | Koh et al. | 219/216 |
| 5,225,874 A | | 7/1993 | Koh et al. | 355/285 |
| 5,241,155 A | | 8/1993 | Koh et al. | 219/216 |
| 5,300,999 A | | 4/1994 | Koh et al. | 355/289 |
| 5,305,066 A | | 4/1994 | Koh et al. | 355/289 |
| 5,367,369 A | | 11/1994 | Nakai et al. | 355/285 |
| 6,148,163 A | * | 11/2000 | Ito | 399/67 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes a fixing unit that performs thermal fixation for a sheet on which a developer has been transferred, and a controller that sets a temperature of the fixing unit at one of a first temperature for fixing a developer expressing a monochrome image on a sheet and a second temperature for fixing developers expressing a color image on a sheet, wherein if a color page is contained in an image forming job, the controller sets the temperature of the fixing unit at the second temperature and starts the image forming job.

8 Claims, 13 Drawing Sheets

FIG. 13

STORAGE MEDIUM SUCH AS FD/CD-ROM

| DIRECTORY INFORMATION |
| --- |
| FIRST DATA PROCESSING PROGRAM PROGRAM CODE GROUP CORRESPONDING TO FLOWCHART SHOWN IN FIG. 8 |
| SECOND DATA PROCESSING PROGRAM PROGRAM CODE GROUP CORRESPONDING TO FLOWCHART SHOWN IN FIG. 12 |
| |

MEMORY MAP OF STORAGE MEDIUM

IMAGE FORMING APPARATUS, CONTROL METHOD AND PROGRAM FOR THE IMAGE FORMING APPARATUS, AND STORAGE MEDIUM

BACKGROUND OF THE INVENTION

1. Field of the Invention

The present invention relates to an image forming apparatus that adopts an electrostatic recording process, an electrophotographic recording process, or the like.

2. Related Background Art

Hereinafter, there will be described how a fixing device of an image forming apparatus of this type is controlled.

When the power supply of a conventional color image forming apparatus (such as a copying machine or a printer) that adopts an electrostatic recording process, an electrophotographic recording process, or the like is turned on, electrical energization of a fixing heater is performed until a fixing device reaches a print startable temperature. When the temperature of the fixing device reaches a printable temperature, it becomes possible to perform a print operation and the electrical energization of the fixing heater is terminated. When the temperature of the fixing device falls below the printable temperature again, the electrical energization is performed once more.

Also, there is proposed an image forming apparatus that has a low-power mode with which if a state where no print job is inputted continues for a predetermined time period, the electrical energization of a fixing heater is continuously interrupted, thereby reducing power consumption in standby.

This image forming apparatus is constructed so that when the inputting of a print job is performed again under a state where the low-power mode is set, the electrical energization of the fixing heater is resumed and, when it is detected that the fixing temperature rises to the print startable temperature, a print operation is started.

In general, in many cases, an image forming apparatus that is used at an office or the like and is shared by many users is set so that the transition to the low-power mode is performed using a timer. Also, in many cases, if the image forming apparatus is used with low frequency, each time a print job is inputted, the fixing device is heated from a power-saving state to a standby state and then print is started.

In such a case, if a long time is taken by the fixing device to return to the standby state, a print waiting time is elongated, which hinders the working efficiency of users from increasing. In addition, there occurs a problem in that power consumed by the fixing device to return from the low-power mode to the standby state is increased because an electrical energization time of the fixing device is elongated.

SUMMARY OF THE INVENTION

An object of the present invention is to provide an image forming apparatus as will be described below. According to the present invention, there is provided an image forming apparatus, comprising:

a fixing unit that performs thermal fixation for a sheet on which a developer has been transferred; and a controller that sets a temperature of the fixing unit at one of a first temperature for fixing a developer expressing a monochrome image on a sheet and a second temperature for fixing developers expressing a color image on a sheet, wherein if a color page is contained in an image forming job, the controller sets the temperature of the fixing unit at the second temperature and starts the image forming job.

BRIEF DESCRIPTION OF THE DRAWINGS

FIG. 13 illustrates a memory map of a storage medium in which there are stored various kinds of data processing programs that are readable by the image forming apparatus according to the present invention.

DESCRIPTION OF THE PREFERRED EMBODIMENTS (First Embodiment)

Figure 1:
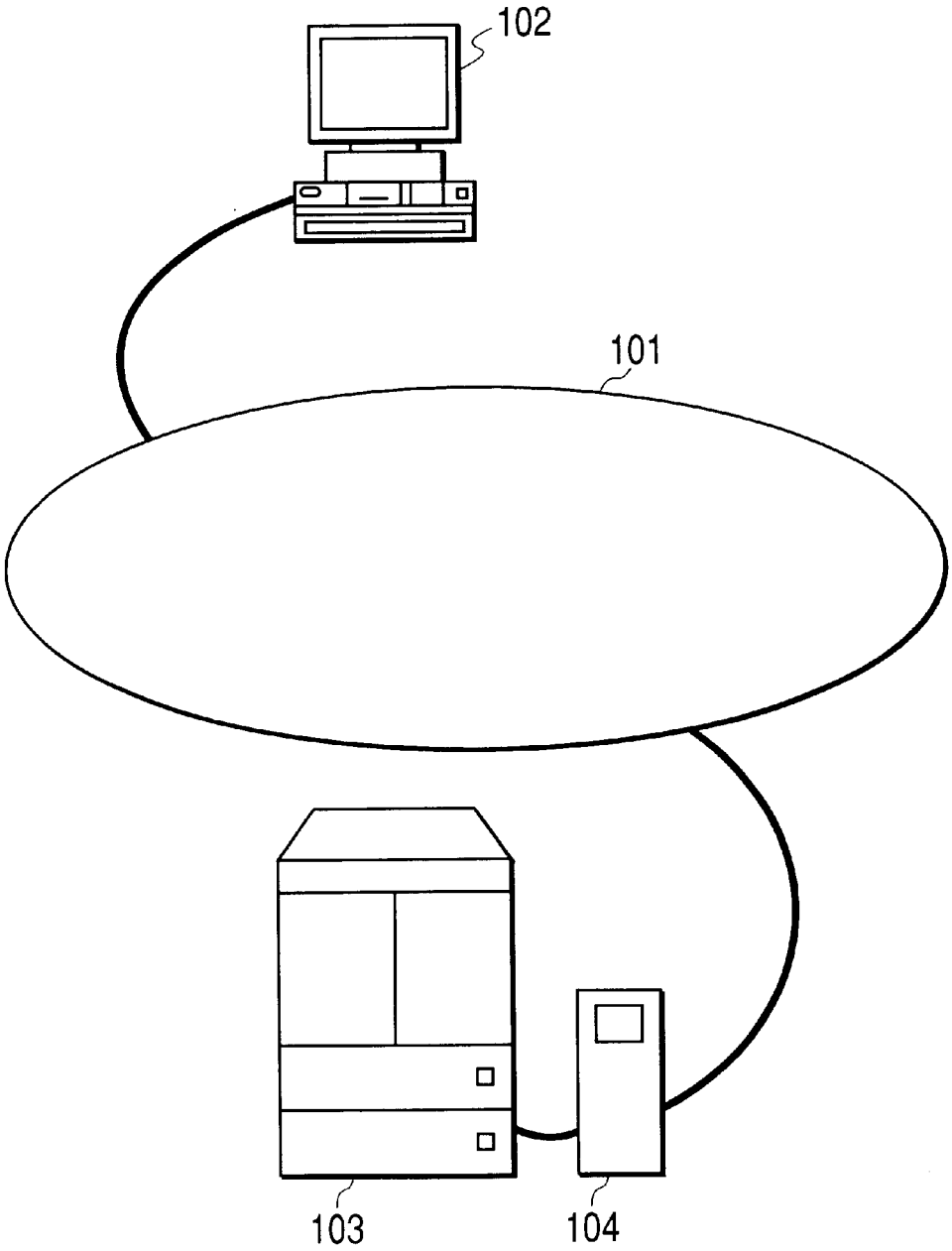
FIG. 1 shows an image forming system to which it is possible to apply an image forming apparatus showing a first embodiment of the present invention.

FIG. 1 shows an image forming system to which it is possible to apply an image forming apparatus showing a first embodiment of the present invention.

In FIG. 1, reference numeral 101 denotes a network, such as the Ethernet (trademark), and reference numeral 102 represents a host computer that is connected onto the network 101.

Reference numeral 103 indicates a copying machine main body (hereinafter simply referred to as the "copying machine") and reference numeral 104 designates a network controller that is used by the copying machine 103 to receive a print job sent over the network 101. Note that this embodiment is described as if the main body of the copying machine 103 and the network controller 104 are constructed from different devices, although there may obtained a construction where the network controller is built inside the copying machine.

If a document created on a computer is a monochrome file such as a text document, the host computer 102 sends the document to the copying machine 103 on the network 101 as a monochrome print job. On the other hand, if the created document is a color file such as graphics, the host computer 102 sends the document to the copying machine 103 as a color print job.

As described above, the copying machine 103 (network controller 104) is connected onto the network 101 and realizes remote printing by receiving print commands from the host computer 102 existing on the same network 101.

Also, in FIG. 1, there is illustrated a state where only one host computer exists on the network 101. In most actual cases, however, a plurality of computers are connected and the copying machine 103 (network controller 104) on the network 101 receives job requests from a plurality of operators at the same time and successively executes the jobs in the order in which the jobs arrive the copying machine.

Figure 2:
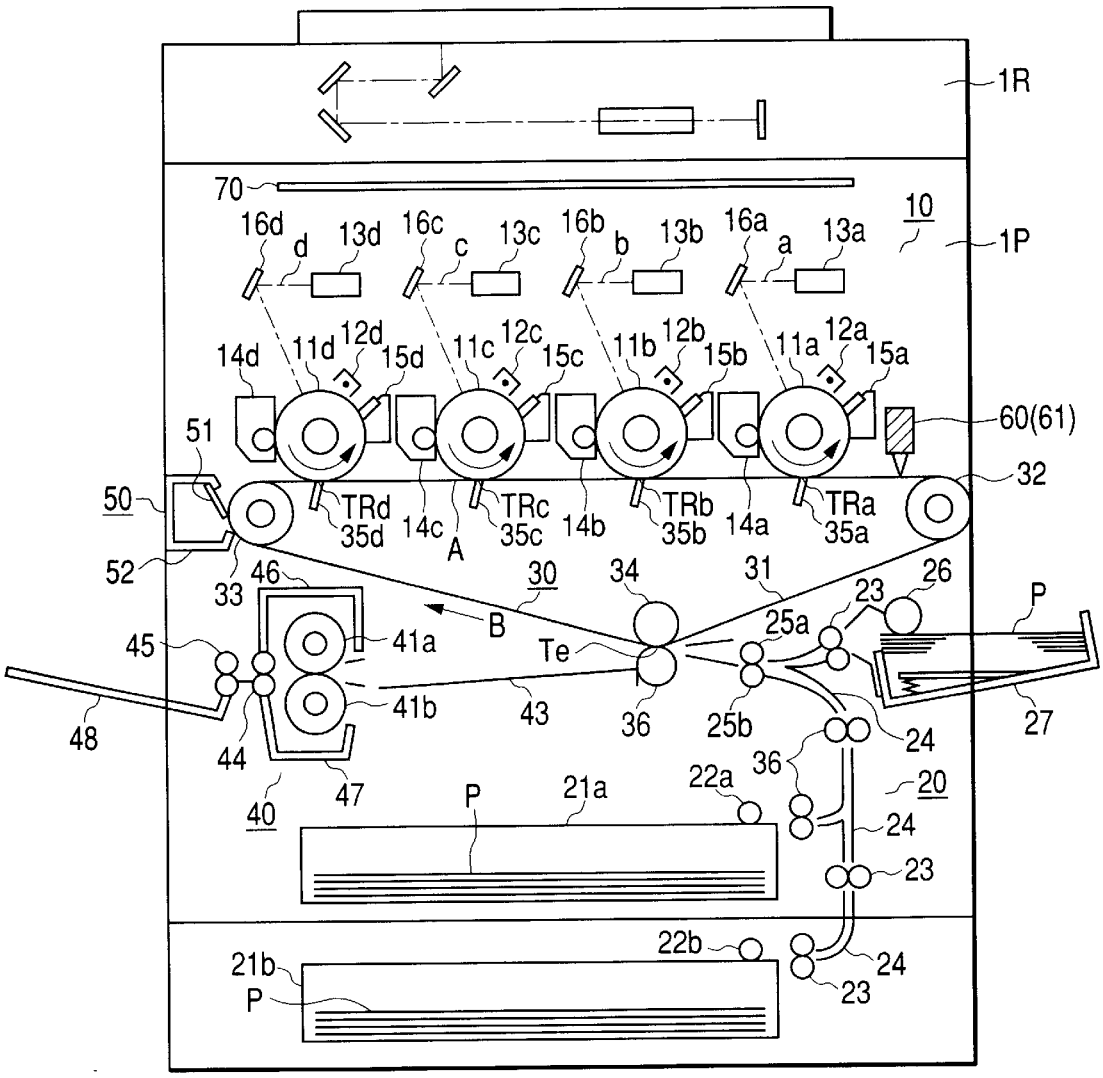
FIG. 2 is a cross-sectional view showing a construction of a copying machine shown in FIG. 1.

FIG. 2 is a cross-sectional view showing a construction of the copying machine 103 shown in FIG. 1.

In FIG. 2, the reference symbol "1R" denotes an image reader that is capable of reading image data from an original placed on an original stand.

Also, the reference symbol "1P" represents an image output portion that is broadly constructed from an image forming portion 10 (in which four stations a, b, c, and d are arranged in parallel, with these stations having the same construction), a feed unit 20, an intermediate transfer unit 30, a fixing unit 40, and a control unit.

Hereinafter, each unit will be described in detail.

The image forming portion 10 has a construction described below.

Photosensitive drums 11*a*, 11*b*, 11*c*, and 11*d* that each function as an image bearing member are pivotally supported at their centers and are rotationally driven in the direction shown by the arrows. Primary chargers 12*a*, 12*b*, 12*c*, and 12*d*, optical systems 13*a*, 13*b*, 13*c*, and 13*d*, developing devices 14*a*, 14*b*, 14*c*, and 14*d*, and cleaning devices 15*a*, 15*b*, 15*c*, and 15*d* are disposed along the rotation directions so as to be opposed to the outer peripheral surfaces of the photosensitive drums 11*a*, 11*b*, 11*c*, and 11*d*.

Hereinafter, there will be described an image forming process of the image forming portion 10.

First, the primary chargers 12*a*, 12*b*, 12*c*, and 12*d* give charges having uniform electrification amounts to the surfaces of the photosensitive drums 11*a*, 11*b*, 11*c*, and 11*d*. Next, the optical systems 13*a*, 13*b*, 13*c*, and 13*d* have the photosensitive drums 11*a*, 11*b*, 11*c*, and 11*d* exposed to rays of light (laser beams, for instance) modulated in accordance with a recording image signal, thereby forming electrostatic latent images on the photosensitive drums. Further, the electrostatic latent images are visualized by the developing devices 14*a*, 14*b*, 14*c*, and 14*d* that respectively contain developers (toners) in four colors that are, for instance, yellow (Y), cyan (C), magenta (M), and black (K).

On the downstream side of image transfer regions TRa, TRb, TRc, and TRd in which visible images obtained as a result of the visualization are transferred onto an intermediate transfer member, the cleaning devices 15*a*, 15*b*, 15*c*, and 15*d* perform the cleaning of the surfaces of the drums by scraping off toners that are not transferred onto the transferring material and reside on the photosensitive drums 11*a*, 11*b*, 11*c*, and 11*d*. As a result of the process described above, image formation using each toner is performed in succession.

Meanwhile, the feed unit 20 is constructed from cassettes 21*a* and 21*b* that contain recording materials P, a manual feeding tray 27, pickup rollers 22*a*, 22*b*, and 26 for sending the recording materials P one by one from the inside of the cassettes or from the manual feeding tray, a feed roller pair 23 and a feed guide 24 for transporting the recording materials P sent from respective pickup rollers to registration rollers, and the registration rollers 25*a* and 25*b* for sending the recording materials P to a secondary transfer region Te in synchronism with an image forming timing of the image forming portion.

Next, there will be described the intermediate transfer unit 30. Reference numeral 31 denotes an intermediate transfer belt (as its material, PET (polyethylene terephthalate), PVdF (polyvinylidene fluoride), or the like is used, for instance). This belt is looped around a drive roller 32 that transmits a driving force to the intermediate transfer belt 31, a tension roller 33 that gives an appropriate tension to the intermediate transfer belt 31 using energization given by a spring (not shown), and a driven roller 34 that is opposed to the secondary transfer region Te with the belt being sandwiched therebetween.

A primary transfer plane A is formed between the drive roller 32 and the tension roller 33 among these construction elements. Also, the drive roller 32 has a construction where the surface of a metallic roller is coated with a rubber layer (made of urethane or chloroprene) whose thickness is several mm, thereby preventing the slipping of the belt. This drive roller 32 is rotationally driven by a pulse motor (not shown).

Also, in the primary transfer regions TRa, TRb, TRc, and TRd in which the respective photosensitive drums 11*a*, 11*b*, 11*c*, and 11*d* are opposed to the intermediate transfer belt 31, primary transfer blades 35*a*, 35*b*, 35*c*, and 35*d* are disposed on the backside of the intermediate transfer belt 31.

Further, a secondary transfer roller 36 is disposed so as to be opposed to the driven roller 34, thereby forming the secondary transfer region Te in a nip portion between the secondary transfer roller 36 and the intermediate transfer belt 31. The secondary transfer roller 36 is pressurized against the intermediate transfer belt 31 with an appropriate pressure.

Also, on the intermediate transfer belt 31, a cleaning device 50 for cleaning the image forming surface of the intermediate transfer belt 31 is disposed on the downstream side of the secondary transfer region Te. This cleaning device 50 is constructed from a cleaner blade 51 (as its material, polyurethane rubber or the like is used) and a waste toner box 52 for containing waste toner.

Next, there will be described the fixing unit 40. The fixing unit 40 is constructed from a fixing roller 41*a* that includes a heat source like a halogen heater inside thereof, a pressure roller 41*b* that is pressurized against this fixing roller (there is a case where this roller is also provided with a heat source), a guide 43 for guiding the recording materials P to a nip portion between the paired rollers described above, inside delivery rollers 44 and outside delivery rollers 45 that further guide the recording materials P delivered from the paired rollers described above to the outside of the apparatus, and the like.

Also, the control unit described above is constructed from a control substrate 70 for controlling the operation of the mechanism within each unit described above, a motor drive substrate (not shown), and the like.

Hereinafter, there will be described an image forming operation.

When an image forming operation start signal is issued, first, the recording material P is sent from the cassette 21*a* by the pickup roller 22*a* one by one. Then, the recording material P is transported by the feed roller pair 23 to the registration rollers 25*a* and 25*b* while being guided between the feed guides 24. During this operation, the registration rollers 25*a* and 25*b* are stopped and the paper leading edge is hit against a nip portion between them. Following this, the registration rollers 25*a* and 25*b* start to rotate in synchronism with a timing at which the image forming portion starts image formation. The rotation timing is set so that, in the secondary transfer region Te, the recording material P is registered with a toner image primarily transferred onto the intermediate transfer belt 31 by the image forming portion.

On the other hand, in the image forming portion 10, when the image forming operation start signal is issued, a toner image formed by the process described above on the photosensitive drum 11*d* that exists on the uppermost stream side in the rotation direction of the intermediate transfer belt 31 is primarily transferred onto the intermediate transfer belt 31 in the primary transfer region TRd by the primary transfer charger (blade) 35*d* to which a high voltage is applied. The primarily transferred toner image is transported to the next primary transfer region TRc. In this primary transfer region TRc, image formation is performed while maintaining a delay corresponding to a time taken to transport the toner image between respective image forming portions, so that the next toner image is registered with and transferred onto the image, which has already been transferred. Following this, the same operation is repeated, thereby primarily transferring toner images in four colors onto the intermediate transfer belt 31.

Following this, when the recording material P enters into the secondary transfer region Te and contacts the intermediate transfer belt 31, a high voltage is applied to the secondary transfer roller 36 in synchronism with the passing timing of the recording material P. Then, the toner images in four colors formed on the intermediate transfer belt 31 by the process described above are transferred onto the surface of the recording material P.

After that, the recording material P is guided to a fixing roller nip portion by the transport guide 43 with precision. Then, the toner images are fixed onto the paper surface by the heat from the pair of rollers 41*a* and 41*b* and the pressure of the nip. Then, the recording material P is transported by the inside delivery rollers 44 and the outside delivery rollers 45, and the paper is delivered to the outside of the apparatus (delivered to a delivery tray 48). Note that the fixing unit 40 is provided with a temperature sensor (not shown) that measures the temperature of the fixing roller.

Next, there will be described how the fixing unit 40 is controlled.

When a power supply is turned on, the electrical energization of the fixing heater (heat source such as a halogen heater) is performed until the temperature of the fixing unit 40 reaches a print startable temperature. When the temperature of the fixing unit 40 reaches the predetermined temperature, a print operation becomes possible and, at the same time, the electrical energization of the fixing heater is terminated. When the temperature of the fixing device falls below the printable temperature again, the electrical energization is performed once more.

Further, the copying machine 103 has a low-power mode that will be set if a state where no print job is inputted continues for a predetermined time period. In this mode, the electrical energization of the fixing heater is continuously interrupted, thereby reducing power consumption in standby.

When the inputting of a print job is performed again under a state where the low-power mode is set, the electrical energization of the fixing heater is resumed, and when it is detected that a fixing temperature rises to the predetermined temperature, a print operation is started.

Also, the copying machine 103 has two print modes: a full-color mode in which an image is formed using toners in four colors of yellow (Y), magenta (M), cyan (C), and black (K); and a monochrome mode in which an image is formed using only a toner in black (K).

In the case where data inputted from the host computer 102 or the image input portion 1R is monochrome data such as a text document, print is performed in the monochrome mode. On the other hand, in the case where the inputted data is color data that includes a color image or the like, print is performed in the full-color mode.

Also, it is possible for the image forming apparatus to automatically discriminate this print mode by discriminating the type of the inputted data. Alternatively, it is possible to specify the color mode (print mode) and to send information showing the specified mode from the host computer 102 or an operation panel described below.

Hereinafter, the operation panel of the copying machine 103 that is not shown in FIG. 2 will be described with reference to FIGS. 3A, 3B, 3C, and 3D.

FIGS. 3A to 3D are each a plain view showing a general view of the operation panel of the copying machine 103 shown in FIG. 2.

Figure 3A:
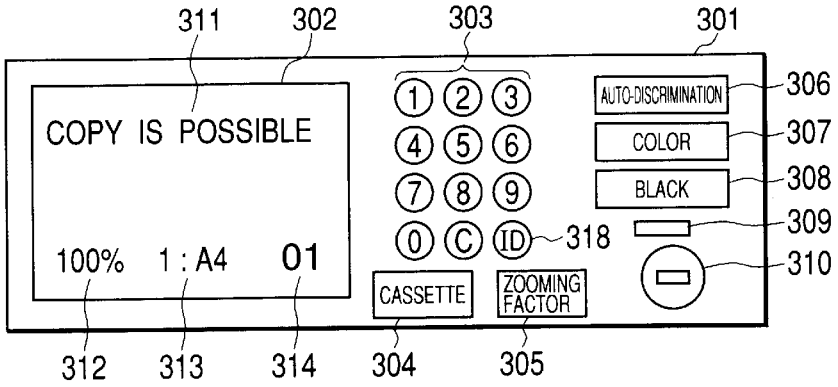
FIGS. 3A, 3B, 3C, and 3D are each a plan view showing a general view of an operation panel of the copying machine shown in FIG. 2.
Figure 3B:
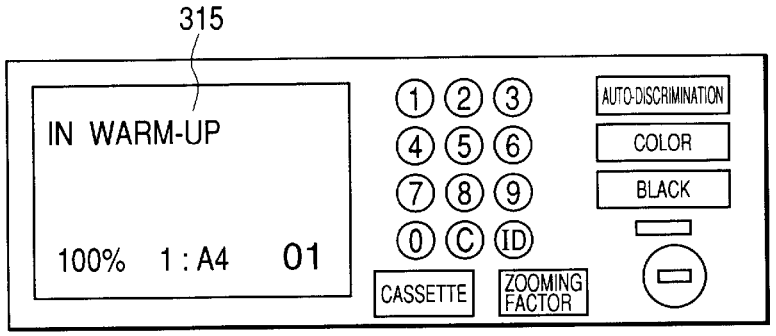
Figure 3C:
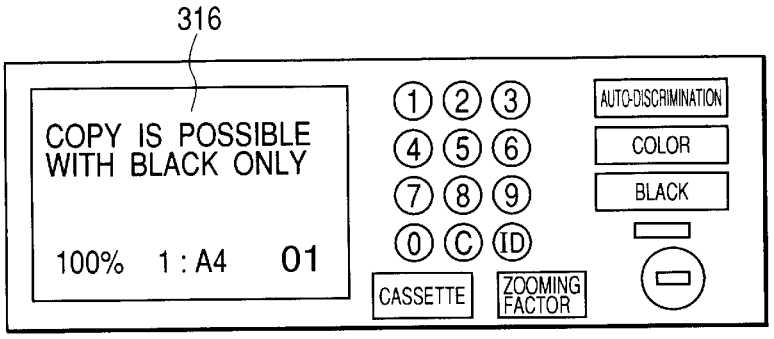
Figure 3D:
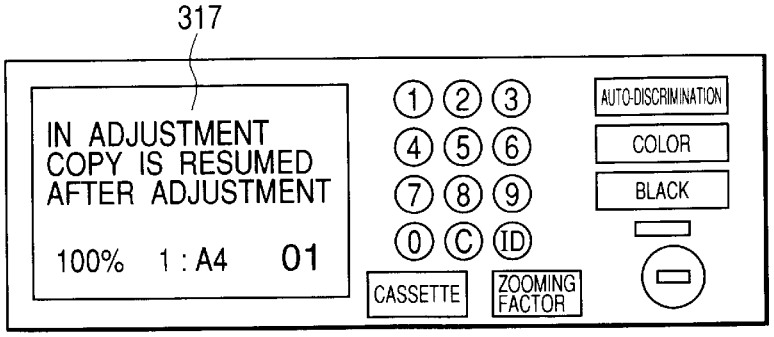

In FIG. 3A, reference numeral 301 denotes the operation panel of the copying machine 103. Reference numeral 302 represents an operation liquid crystal panel in which the current state of the copying machine or the like is displayed in the manner shown by state indications 311 and 315 to 317.

Reference numeral 303 denotes a ten-key with which there is inputted the number of copies to be made and a zooming factor for enlargement or reduction. The inputted number of copies to be made is displayed in the manner shown by a copy number indication 314 and the zooming factor is displayed in the manner shown by a zooming factor indication 312. Reference numeral 304 indicates a cassette selection key. By pushing this key, it is possible to select a feed stage. A currently selected feed stage is displayed in the manner shown by a selected feed stage indication 313. Reference numeral 305 denotes a zooming factor setting key. When this key 305 is pushed, a copy zooming factor setting screen (not shown) is displayed on the operation panel 302 and it becomes possible to input a desired zooming factor through the operation of the ten key 303.

Also, reference numeral 306 is a color mode (print mode) discrimination key, and when this key is pushed prior to the start of copying, the copying machine 103 automatically discriminates an optimum color mode with reference to a read original or image data.

Reference numerals 307 and 308 respectively indicate keys that will be respectively pushed to select the color mode (full-color mode) and the black mode (monochrome mode). A pushed key emits light, thereby allowing a user to easily confirm a currently selected color mode.

Reference numeral 309 is a cancel key, and when this key is pushed during copying, a copy job is aborted. Also, by pushing this cancel key 309 during standby, it is possible to return the currently set number of copies to be made, feed stage, color mode, and the like to default settings.

Reference numeral 310 denotes a copy start key, and when this key is pushed during standby, copying is started.

Also, when this key is pushed in warm-up, a job is scheduled, which makes it possible to start copying immediately after the copying machine enters a standby state.

Reference numeral 318 represents an ID key and is pushed to input a user ID. Note that with reference to a user ID inputted by operating the ten key 303 after the pushing of this key, the owner of a copy job is set. Also, there may be obtained a construction where the owner of a copy job is set by inserting a user card into a card slot (not shown).

The state indications 311, 315, 316, and 317 displayed on the operation liquid crystal panel 302 respectively correspond to a state where copy is possible, a state where the copying machine is in warm-up, a state where copy is possible with black only, and a state where the copying machine is in adjustment.

Figure 4:
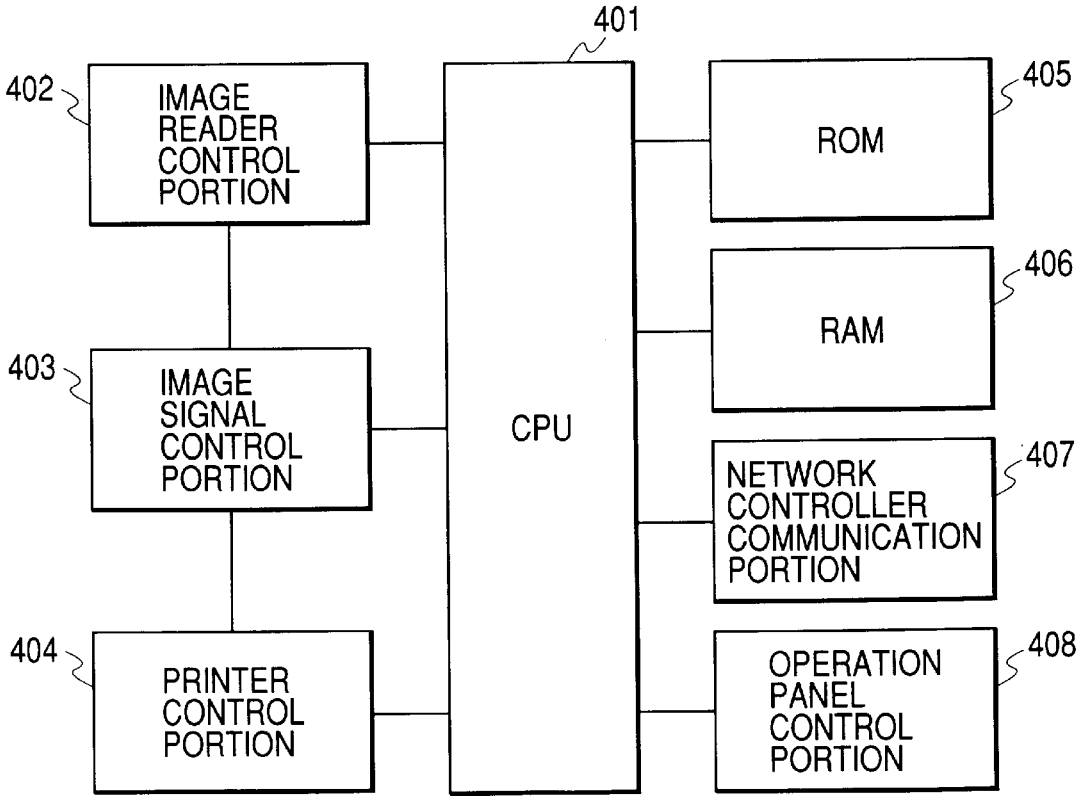
FIG. 4 is a block diagram showing a construction of a control unit of the copying machine shown in FIG. 1.

FIG. 4 is a block diagram showing the construction of the control unit of the copying machine 103 shown in FIG. 1.

In FIG. 4, reference numeral 401 denotes a CPU that executes a control program based on a ROM 405, in which programs and data are stored, and a RAM 406 in which a program stack, variables, and variable data are stored. Reference numeral 402 indicates an image reader control portion and the CPU 401 controls the image reader 1R via this image reader control portion 402.

Reference numeral 403 indicates an image signal control portion that converts an original image inputted from the image reader control portion 402 or a print job inputted from a network controller communication portion 407 to be described later into an output image for a printer.

Reference numeral 404 denotes a printer control portion, and the CPU 401 controls the image output portion 1P via this printer control portion 404. Also, the network controller communication portion 407 communicates with the network controller 104 and receives a print job from the network. Reference numeral 408 denotes an operation panel control portion via which the CPU 401 controls the operation panel shown in FIGS. 3A to 3D.

As shown in FIG. 2, in the color image forming apparatus adopting an electrophotographic process that transfers toners in four colors of yellow (Y), magenta (M), cyan (C), and black (K) onto a transfer sheet if the full-color mode is set, the amount of toner transferred onto the sheet greatly varies depending on which one of the monochrome mode and the color mode is set. Therefore, the quantity of heat that the fixing roller 41*a* is capable of giving to a toner image per unit area becomes large when the monochrome mode is set, in comparison with a case where the color mode is set. Therefore, it is possible to perform fixation at a lower fixing temperature when the monochrome mode is set.

In view of this fact, when the power supply is turned on or when the low-power mode is canceled (both of these operations will be hereinafter referred to as the "start of waiting up"), the temperature of the fixing device starts to rise. When the temperature of the fixing device reaches a temperature at which print is possible in the monochrome mode, only jobs in the monochrome mode are set as printable first, thereby making it possible to minimize a waiting time during warm-up from the turning on of the power supply or from the returning from the low-power mode.

Figure 5A:
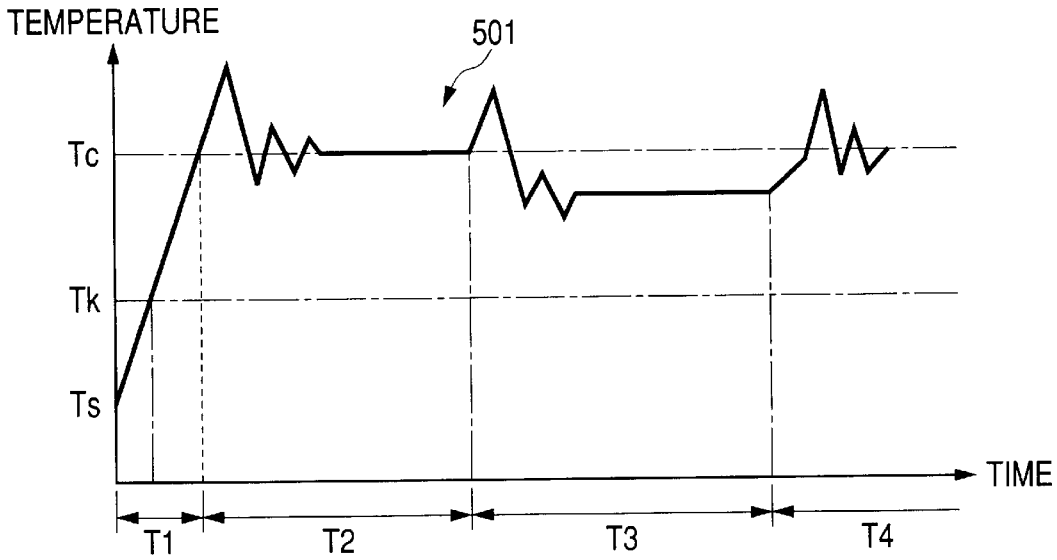
FIGS. 5A and 5B are each a characteristic graph showing transition of a temperature of a fixing roller in the first embodiment of the present invention.
Figure 5B:
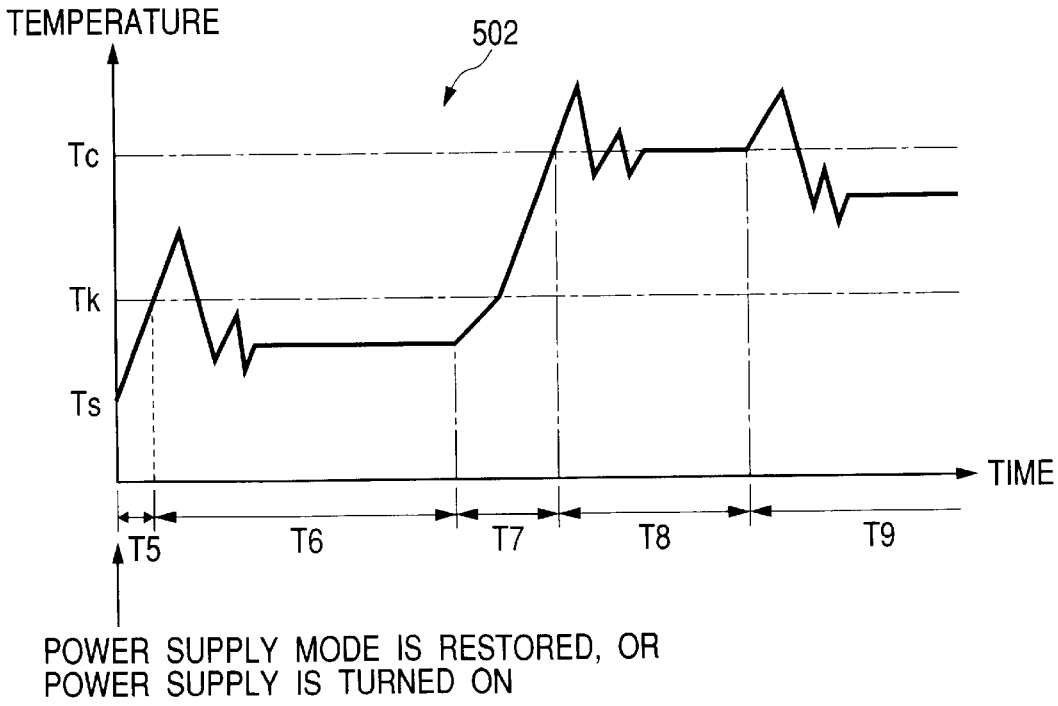

FIGS. 5A and 5B are each a characteristic diagram showing the transition of the temperature of the fixing roller 41*a* in the first embodiment of the present invention.

FIG. 5A is a graph 501 showing the temperature of the fixing roller 41*a* in the case where print is started after there is obtained a state where both of monochrome print and color print are possible.

FIG. 5B is a graph 502 showing the temperature of the fixing roller 41*a* in the case where print is started after the power supply is turned on and there is obtained a state where only monochrome print is possible.

First, in the temperature graph 501, the temperature of the fixing roller when the power supply is turned on is Ts and a target temperature is set as Tc. The fixing heater is continuously turned on until the fixing roller temperature reaches Tc. When the temperature rises to Tc and exceeds Tc after a time T1 has elapsed, the heater is turned off. When the temperature falls below Tc, the heater is turned on again. When print is started during a time T2, the fixation onto a sheet provides heat removal from the fixing heater during a print time T3, so that the fixing roller temperature falls below the control temperature Tc. When the print is finished, the copying machine enters a state where it is possible to receive a print request and the fixing roller temperature is controlled and maintained at Tc as indicated by T4.

In the temperature graph 502, the fixing roller temperature when the power supply is turned on is Ts and the target temperature is set as Tc, like in the temperature graph 501. The fixing heater is continuously turned on until the fixing roller temperature reaches TC. However, the fixing roller temperature reaches a monochrome standby temperature Tk after a time T5 has elapsed, so that only monochrome print becomes possible.

Here, when print of a monochrome job is started, the fixation onto a sheet provides heat removal from the fixing heater during a print time T6, so that the fixing roller temperature falls below the monochrome standby temperature. When the print is finished, the temperature rises and reaches Tc after a time T7. When the temperature exceeds Tc, the heater is turned off. On the other hand, if the temperature falls below Tc, the heater is turned on. If print is started during a time T8, the fixation onto a sheet provides heat removal from the fixing heater during a print time T9, so that the fixing roller temperature falls below the control temperature Tc. When the print is finished, the copying machine enters a state where it is possible to receive a print request and the fixing roller temperature is controlled and maintained at Tc.

It should be noted here that in accordance with a measurement result of the temperature of the fixing roller within the fixing unit 40 obtained by the temperature sensor (not shown) provided for the fixing unit 40, the CPU 401 shown in FIG. 4 stores information representing that the temperature of the fixing roller exceeds (reaches) Tc after reaching Tk in the RAM 406. On the other hand, in the case where the temperature of the fixing roller falls below Tc, the CPU 401 resets the storage contents of the RAM 406 (information representing that the temperature of the fixing roller exceeds Tc after reaching Tk). On the basis of the storage contents, the CPU 401 controls the start, suspending, and the like of a job to be described later.

Hereinafter, scheduled jobs and job processing procedures in the image forming apparatus showing the first embodiment of the present invention will be described with reference to FIGS. 6 and 7.

Figure 6:
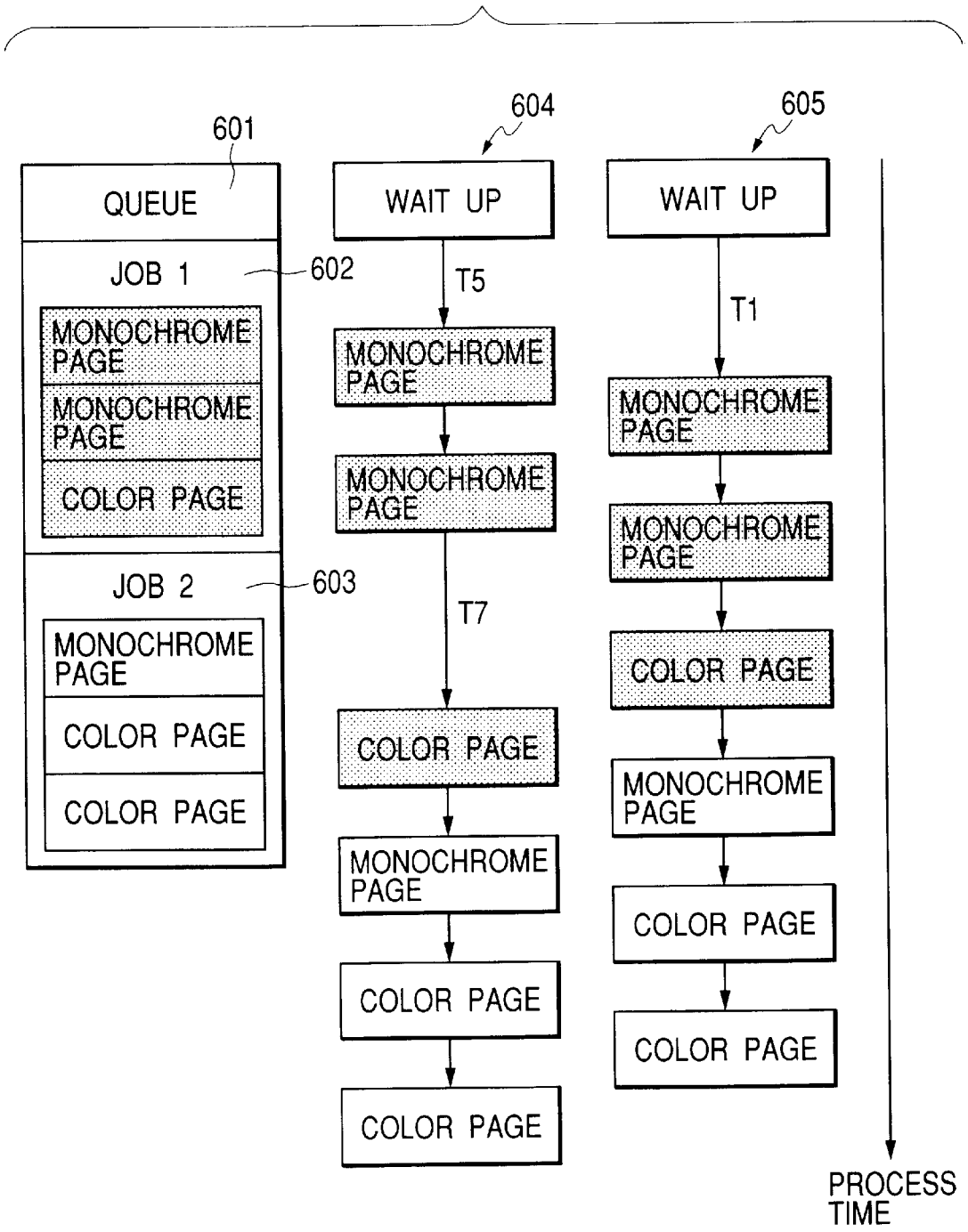
FIG. 6 shows scheduled jobs and job processing procedures in the first embodiment of the present invention.

FIG. 6 shows scheduled jobs and job processing procedures in the first embodiment of the present invention, and corresponds to a case where the head job of a queue to be subjected to a print process after waiting up is a job in which pages in a plurality of color modes (print modes) coexist.

In FIG. 6, reference numeral 601 denotes a queue that is stored in the RAM 406 shown in FIG. 4. Jobs, each of which has been inputted by the network controller communication portion 407 or the operation panel control portion 408, are accumulated in this queue in the order in which the jobs are inputted, and are subjected to a print process in succession via the printer control portion 404.

In this queue 601, jobs are scheduled in the order of Job 1 (602) and Job 2 (603). Further, Job 1 (602) is constructed from three pages that are arranged in the order of a monochrome page, a monochrome page, and a color page. In a like manner, Job 2 (603) is constructed from three pages that are arranged in the order of a monochrome page, a color page, and a color page.

Reference numeral 604 represents job processing control that corresponds to a case where at a point in time when the fixing roller temperature becomes Tk after the start of waiting up, Job 1 (602) and Job 2 (603) are processed in succession.

First, the first page of Job 1 (602) is a monochrome page, so that two monochrome pages are outputted. Here, the next page is a color page, so that the print job is suspended until the temperature of the fixing roller rises from Tk to Tc. When the temperature of the fixing roller rises to Tc, the color page of Job 1 (602) is printed and Job 1 (602) is completed. At this point in time, the temperature of the fixing roller reaches Tc. Therefore, it is not required to suspend Job 2 (603) regardless of whether a monochrome page or a color page is to be printed.

Next, reference numeral 605 denotes job processing control that corresponds to a case where at a point in time when the fixing roller temperature rises to a temperature capable of both of color print and monochrome print after the start of waiting up, Job 1 (602) and Job 2 (603) are processed.

Both of Job 1 (602) and Job 2 (603) are constructed from monochrome pages and color pages. However, the temperature of the fixing roller 41*a* reaches a temperature at which fixation is possible in both of the color modes (print modes), so that it is possible to successively subject Job 1 (602) and Job 2 (603) to a print process without performing a waiting operation during the switching between the color modes.

Here, these two patterns of job processing control that are the job processing control 604 and the job processing control 605 will be compared with each other. The waiting time required from the start of waiting up to the completion of Job 1 (602) becomes "T5+T7" in total in the case of the job processing control 604. On the other hand, in the case of the job processing control 605, the waiting time required from the start of waiting up to the completion of Job 1 (602) becomes "T1" in total. As shown in FIGS. 5A and 5B, "T5+T7" is longer than "T1" and the waiting time in total, during which the fixing roller is heated up, becomes short in the case of the job processing control 605, in comparison with the case of the job processing control 604. As a result, a time required to finish Job 1 (602) also becomes shorter in the case of the job processing control 605.

Also, in the case of the job processing control 604, the suspending of the operation of a print engine further occurs due to the suspending of a print process on the midway of a job, so that the time required to finish Job 1 (602) is further elongated.

As described above, in the image forming apparatus of this embodiment, in the case where a job (head job) queued when the waiting up is started is a mix job in which monochrome pages are mixed with color pages, it becomes possible to quickly process the head job of the queue by starting a print process after the fixing roller temperature reaches Tc (temperature at which print is possible in both of the monochrome print mode and the color print mode).

Hereinafter, a case where the head job of the queue to be subjected to a print process after waiting up in the image forming apparatus of the present invention is a monochrome job will be described with reference to FIG. 7.

Figure 7:
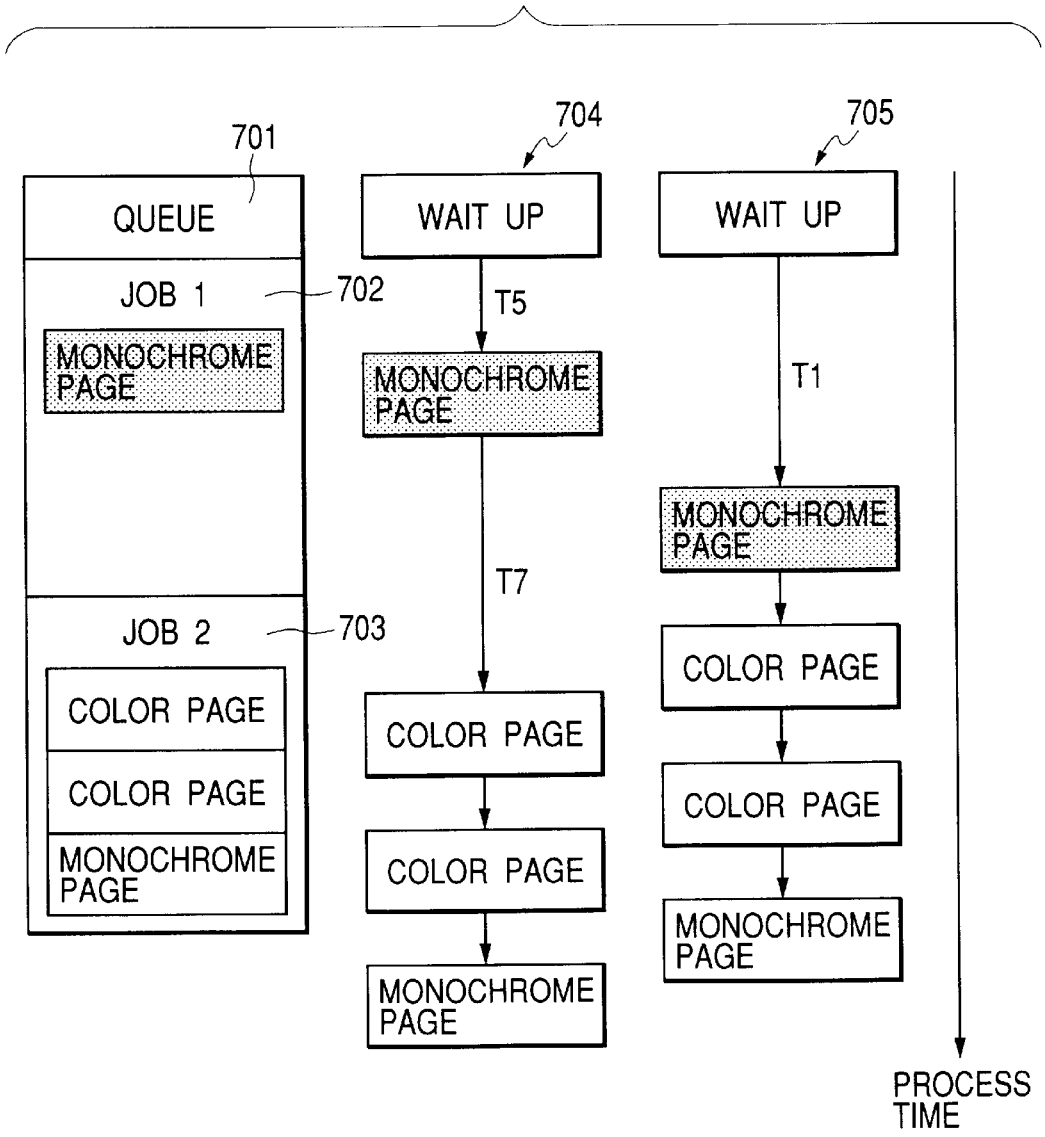
FIG. 7 shows scheduled jobs and job processing procedures in the first embodiment of the present invention.

FIG. 7 shows scheduled jobs and job processing procedures in the first embodiment of the present invention, and corresponds to a case where the head job of the queue to be subjected to a print process after waiting up is a monochrome job.

In FIG. 7, reference numeral 701 denotes a queue in which jobs are scheduled in the order of Job 1 (702) and Job 2 (703). Job 1 (702) is constructed only from a monochrome page. In a like manner, Job 2 (703) is constructed from three pages that are arranged in the order of a color page, a color page, and a monochrome page.

Reference numeral 704 indicates job processing control that corresponds to a case where Job 1 (702) and Job 2 (703) are processed in succession at a point in time when the fixing roller temperature becomes Tk after the start of waiting up.

Job 1 (702) includes the print of only a monochrome page, so that this monochrome page is first outputted. Next, Job 2 (703) is to be processed, although it is required to output a color page contained in Job 2 (703) and therefore this print job is suspended until the temperature of the fixing roller 41*a* rises from the fixing roller temperature capable of only monochrome print to Tc. When the temperature of the fixing roller rises to Tc, two color pages of Job 2 (703) are printed and then one monochrome page is printed. In this manner, Job 2 (703) is completed.

Next, reference numeral 705 denotes job processing control that corresponds to a case where Job 1 (702) and Job 2 (703) are processed at a point in time when the fixing roller temperature becomes Tc after the start of waiting up.

The temperature of the fixing roller reaches a temperature at which it is possible to perform fixation in both of the color modes (print modes), so that it is possible to subject Job 1 (702) and Job 2 (703) to a successive print process without performing a waiting operation during the switching between the modes.

Here, these two patterns of job processing control that are the job processing control 704 and the job processing control 705 will be compared with each other. The waiting time required from the start of waiting up to the completion of Job 1 (702) becomes "T5" in the case of the job processing control 704. On the other hand, in the case of the job processing control 705, the waiting time required from the start of waiting up to the completion of Job 1 (702) becomes "T1" shown in FIG. 5A. As shown in FIGS. 5A and 5B, "T5" is shorter than "T1" and a time until Job 1 (702) is completed becomes short in the case of the job processing control 704, in comparison with the case of the job processing control 705.

As described above, in the image forming apparatus having the construction of this embodiment, in the case where a head job queued when waiting up is started is a monochrome job, it becomes possible to quickly process the head job of the queue by starting a print process at a point in time when the temperature of the fixing roller becomes Tk (temperature at which print is possible only in the monochrome print mode).

In the case where the two jobs queued in the head when waiting up is started are respectively a monochrome job and a color (or mix) job, however, it becomes possible to quickly process a plurality of jobs of the queue by starting a print process at a point in time when the temperature of the fixing roller becomes Tc (temperature at which print is possible in both of the monochrome print mode and the color print mode).

That is, in the present invention, an image forming apparatus queues a plurality of print jobs, is capable of processing the print jobs in succession when placed in a printable state, has a monochrome print mode and a color print mode (the fixation temperature of the color print mode is higher than that of the monochrome print mode), and further has a low-power consumption mode in which it is possible to reduce the power consumption in standby by interrupting the electrical energization of a fixing unit. This image forming apparatus is capable of minimizing a waiting time during warm-up from the turning on of a power supply by enabling print of only jobs in the monochrome mode first when the temperature of the fixing device rises and reaches a temperature, at which print is possible in the monochrome mode, after the power supply is turned on or after the low-power mode is released (both of these operations will be hereinafter referred to as the "start of waiting up"). In a like manner, at the time of returning from the low-power mode, jobs in the monochrome mode are set as printable prior to color jobs, thereby reducing a returning time.

It should be noted here that in the case where two jobs from the same users are successively queued in the head in the order of a monochrome job and a color job at the time of returning from the low-power consumption mode, the print jobs are started after the fixation standby temperature reaches Tc that is the temperature corresponding to the color print mode. In all other cases (cases where two jobs from the same users are not successively queued in the head in the order of a monochrome job and a color job at the time of returning from the low-power consumption mode), the print jobs are started after the fixing roller has gone to the fixation standby temperature corresponding to the color mode of a job queued as the head job (after the fixing roller has gone to Tk if the head job is a monochrome job, or after the fixing roller has gone to Tc if the head job is a color (mix) job).

Hereinafter, a print processing operation of the image forming apparatus of the present invention after waiting up will be described with reference to FIG. 8.

Figure 8:
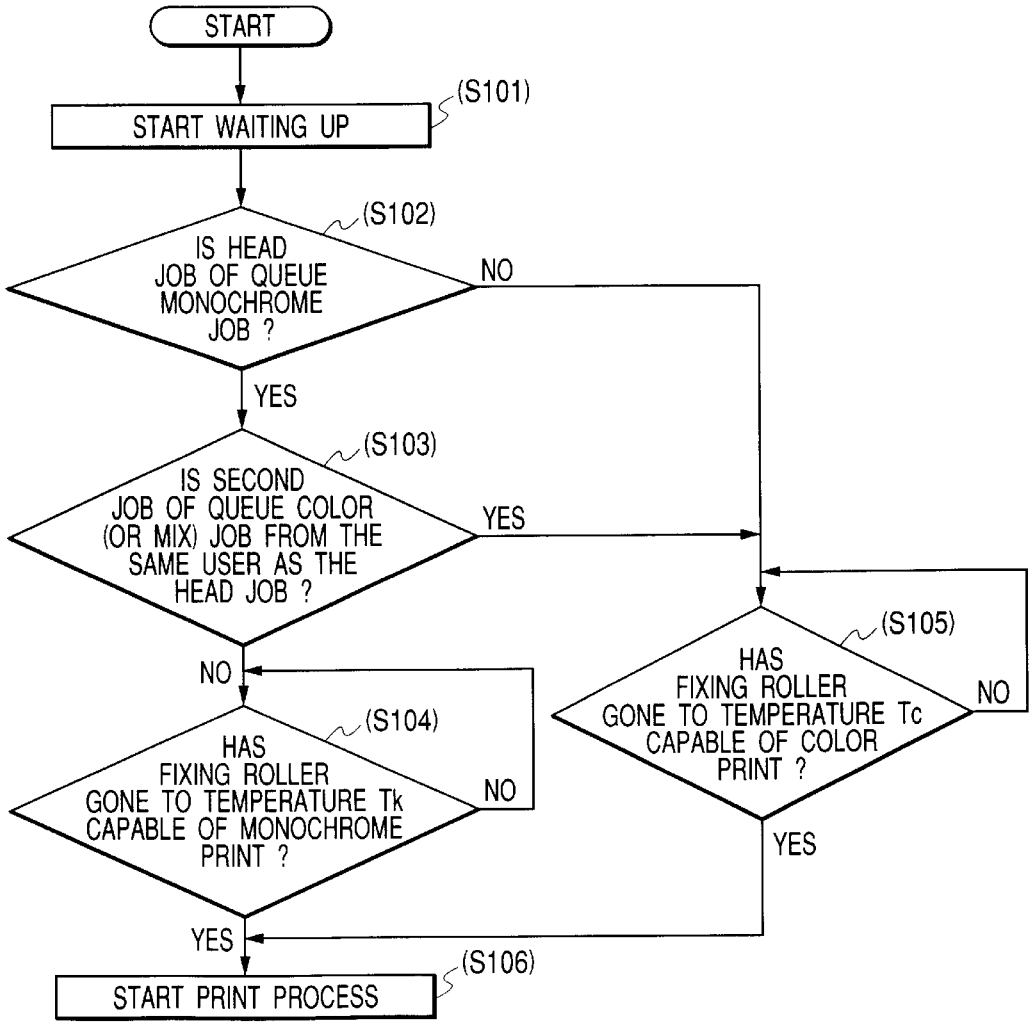
FIG. 8 is a flowchart showing an example of a first control processing procedure of the image forming apparatus of the present invention.

FIG. 8 is a flowchart showing an example of a first control processing procedure of the image forming apparatus of the present invention, and corresponds to a print processing procedure after waiting up. Note that the processing in this flowchart is realized by the CPU 401 shown in FIG. 4 based on a program stored in the ROM 405 or a storage medium (not shown). Also, reference symbols S101 to S106 respectively indicate Steps.

First, when waiting up is started in Step S101, it is judged whether the head job of the queue to be subjected to a print process is a monochrome job in Step S102. In the case where it has been judged that the head job is a monochrome job, the processing proceeds to Step S103 in which it is judged whether the second job of the queue to be subjected to the print process is a job from the same user as the first monochrome job and is a color (or mix) job (that is, it is judged whether the two jobs in the head are jobs from the same user and are queued in the order of a monochrome job and a color (or mix) job). In the case where it has been judged that the second job of the queue to be subjected to the print process is a job from the same user as the first monochrome job and is a color (or mix) job (that is, it has been judged that the two jobs in the head are jobs from the same user and are queued in the order of a monochrome job and a color (or mix) job), the processing proceeds to Step S105 in which it is waited for the fixing roller to have gone to Tc that is a temperature capable of color print. When the fixing roller has gone to Tc, the processing proceeds to Step S106 in which the print process is started.

On the other hand, in the case where it has not been judged that the second job of the queue to be subjected to the print process is a job from the same user as the first monochrome job and is a color (or mix) job (that is, it has not been judged that the two jobs in the head are jobs from the same user and are queued in the order of a monochrome job and a color (or mix) job) in Step S103, the processing proceeds to Step S104 in which it is waited for the fixing roller to have gone to Tk that is a temperature capable of monochrome print. When the fixing roller has gone to the temperature Tk, the processing proceeds to Step S106 in which the print process is started.

On the other hand, in the case where it has not been judged that the head job of the queue is a monochrome job (that is, it has been judged that the head job of the queue is a color (or mix) job) in Step S102, the processing proceeds to Step S105 in which it is waited for the fixing roller to have gone to Tc that is the temperature capable of color print. When the fixing roller has gone to Tc, the processing proceeds to Step S106 in which the print process is started.

As has been described above, the image forming apparatus of the present invention changes a print start temperature after warm-up with reference to the color mode of the head job of the queue. Note that, in particular, in the case where two jobs from the same user are successively queued in the head and in the order of a monochrome job and a color job at the time of returning from the low-power consumption mode, the print jobs are started after the fixation standby temperature reaches Tc that is a temperature corresponding to the color print mode. In other cases (cases where the two jobs in the head are not demanded by the same user or are not successively queued in the order of a monochrome job and a color job at the time of returning from the low-power consumption mode), the print jobs are started after the fixing roller temperature reaches a fixation standby temperature corresponding to the color mode of a job queued as the head job (after the fixing roller temperature reaches Tk if the head job is a monochrome job, or after the fixing roller temperature reaches Tc if the head job is a color (mix) job). By doing so, it becomes possible to shorten a time required to process the first job from a user after the returning from the low-power mode or the like. The present invention is in particular effective in the case where an image forming apparatus is in a circumstance where the inputting of print jobs is performed with low frequency so that the returning from the low-power mode is performed frequently.

(Second Embodiment)

Figure 9:
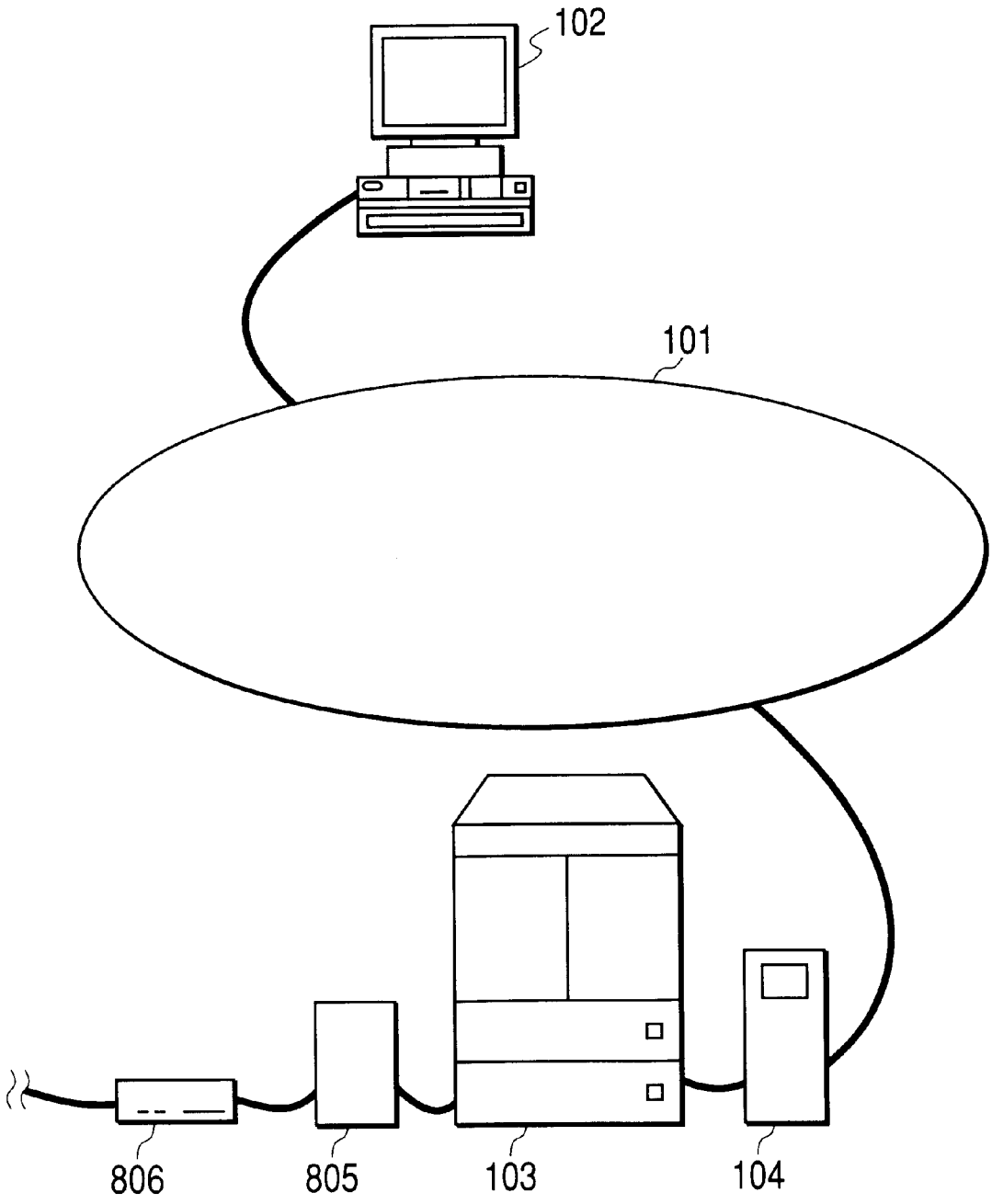
FIG. 9 shows an image forming system to which it is possible to apply an image forming apparatus showing a second embodiment of the present invention.

FIG. 9 shows an image forming system to which it is possible to apply an image forming apparatus showing a second embodiment of the present invention. In FIG. 9, the same elements as in FIG. 1 are given the same reference numerals.

In FIG. 9, reference numeral 805 denotes a FAX (facsimile) controller. A copying machine 103 is a multi-function copying machine that is capable of sending and receiving faxes as well as making copies and performing network printing. The FAX controller 805 is connected to a public telephone line via a modem 806. A FAX document received through the public telephone line is converted from data based on a FAX protocol to image data in the FAX controller 805 and is accumulated in a memory internally possessed by the FAX controller 805.

The FAX controller 805 sends a print request to the copying machine 103 in order to print a FAX job. On receiving this print request from the FAX controller 805, the copying machine 103 stores the FAX job in a print queue.

When jobs in this queue are processed and it becomes possible to print the FAX job, FAX data is subjected to a print process. Also, the FAX data is monochrome data.

When a FAX job or a network print job is received or when the setting of a copy job is inputted from an operation panel, the copying machine 103 is released from the low-power mode.

It should be noted here that the outline, the indications on the operation panel, and the transition characteristics of the temperature of a fixing roller of the copying machine 103 in this embodiment are respectively the same as the cross-sectional view shown in FIG. 2, the indications on the operation panel shown in FIGS. 3A to 3D, and the transition characteristics of the temperature of the fixing roller shown in FIGS. 5A and 5B of the copying machine 103 in the first embodiment. Therefore, the description thereof is omitted in this embodiment.

Figure 10:
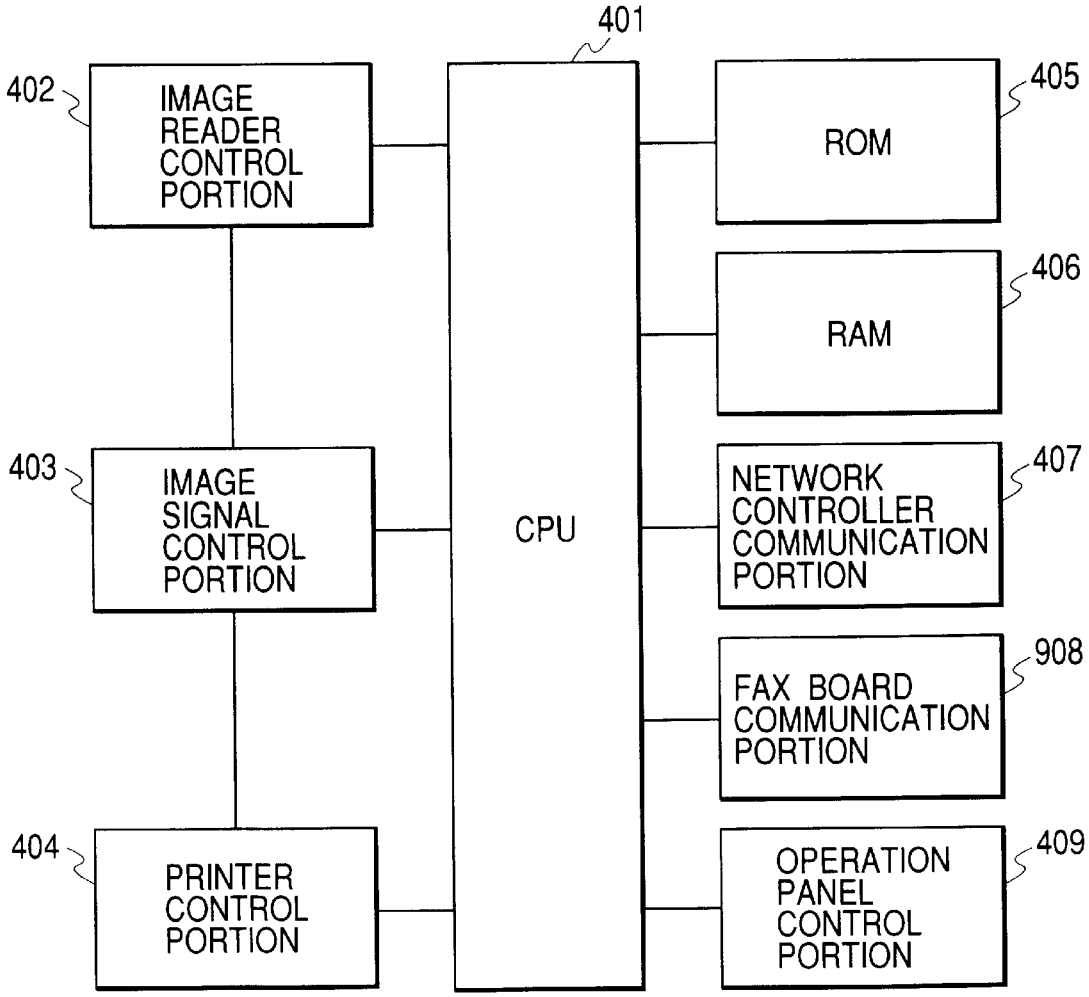
FIG. 10 is a block diagram showing a construction of a control unit of a copying machine shown in FIG. 9.

FIG. 10 is a block diagram showing the construction of a control unit of the copying machine 103 shown in FIG. 9. In this drawing, the same elements as in FIG. 4 are given the same reference numerals.

In FIG. 10, reference numeral 908 denotes a FAX board communication portion that communicates with a FAX board (FAX controller 805), thereby checking the presence or absence of a FAX reception job and realizing the sending and reception of FAX data.

It should be noted here that in accordance with a measurement result of the temperature of the fixing roller within the fixing unit 40 obtained by a temperature sensor (not shown) provided for the fixing unit 40, after the temperature of the fixing roller reaches Tk, the CPU 401 shown in FIG. 10 stores information representing that the temperature exceeds (reaches) Tc in the RAM 406. On the other hand, in the case where the temperature of the fixing roller falls below Tc, the CPU 401 resets the storage contents of the RAM 406 (information representing that the temperature of the fixing roller exceeds Tc after reaching Tk). On the basis of the storage contents, the CPU 401 controls the start, suspending, and the like of a job to be described later.

With this construction, in the case where the copying machine 103 is a multifunction copying machine having copy, print, and FAX functions, with reference to the color modes of queued jobs, the procedure for processing the jobs is controlled so that monochrome jobs are preferentially output after turning on of the power supply or the releasing of the low-power mode. By doing so, in the case of a printer that is in a usage condition where a usage frequency is relatively low, the returning from the low-power mode is frequently performed, and relatively many monochrome jobs are processed, it becomes possible to substantially shorten a waiting time until the completion of a print process.

Hereinafter, scheduled jobs and a job processing procedure in the image forming apparatus showing the second embodiment of the present invention will be described with reference to FIG. 11.

Figure 11:
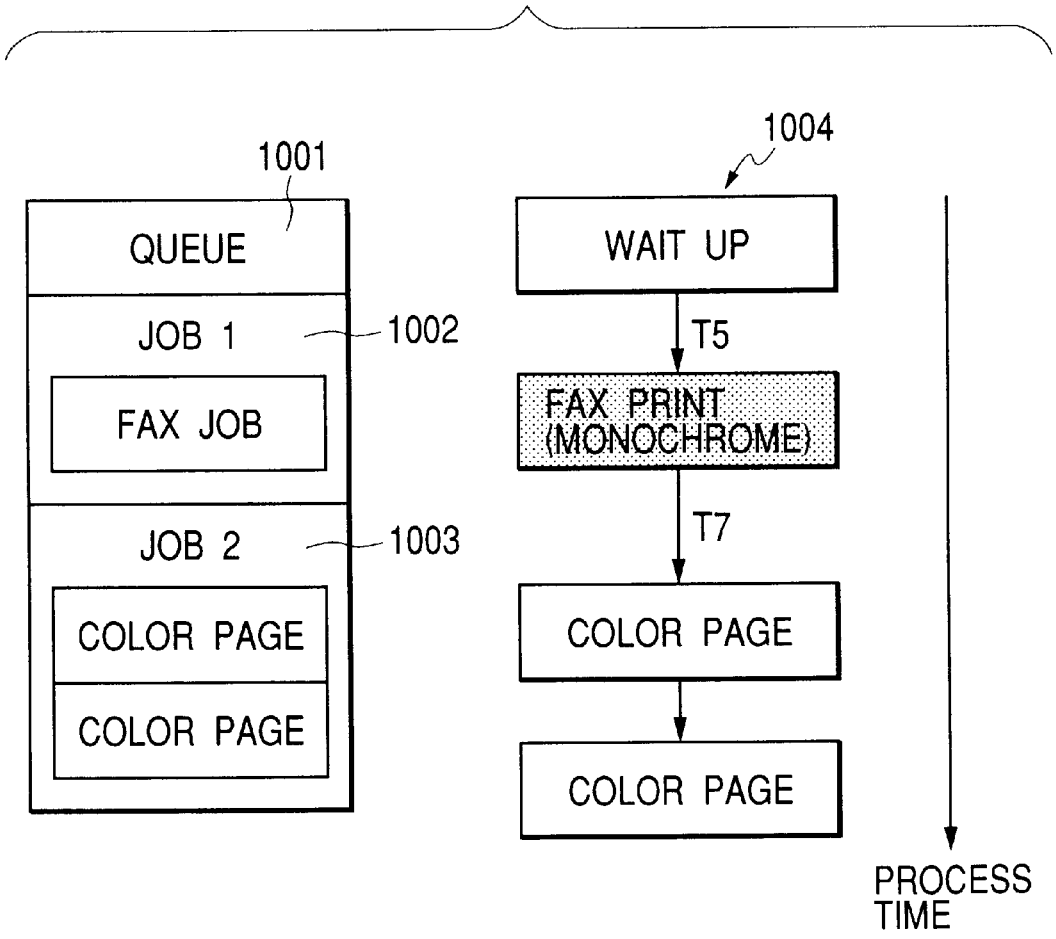
FIG. 11 shows scheduled jobs and a job processing procedure in the second embodiment of the present invention.

FIG. 11 shows scheduled jobs and a job processing procedure in the second embodiment of the present invention, and corresponds to a case where the head job of a queue to be subjected to a print process after waiting up is a FAX job (job for printing facsimile reception data).

In FIG. 11, reference numeral 1001 denotes a queue that is stored in the RAM 406 shown in FIG. 10. Jobs inputted by the FAX board communication unit 908, the network controller communication portion 407, or the operation panel control portion 409 are managed in this queue in the order, in which the jobs are inputted, and are subjected to a print process in succession via the printer control portion 404.

In this queue 1001, jobs are scheduled in the order of Job 1 (1002) and Job 2 (1003). The job 1002 is a FAX job, while the job 1003 is constructed from two pages that are arranged in the order of a color page and a color page.

Reference numeral 1004 indicates job processing control. It is already known that a FAX job exists in the queue, so that the first job is a monochrome job. Accordingly, at a point in time when the fixing roller temperature reaches Tk after the start of waiting up, the FAX job 1002 is subjected to a print process. Here, the next job 1003 is a color job, so that this print job is suspended until the temperature of the fixing roller rises from Tk to Tc. When the temperature of the fixing roller rises to Tc, the printing of the job 1003 is started.

As described above, in the case where a FAX job is the head job of the queue, by starting a print process when the temperature of the fixing heater reaches Tk, it becomes possible to shorten a time required to output the head job from the start of waiting up. Also, this embodiment is based on the assumption that a FAX job exists in the queue. However, even during the reception of a FAX (facsimile), in the case where the low-power mode is released and the temperature of the fixing heater reaches the temperature capable of monochrome print when the reception of the FAX is finished, for instance, it is possible to start the printing of a FAX job under a state where the temperature of the fixing heater is Tk.

Hereinafter, a print processing operation after waiting up of the image forming apparatus showing the second embodiment of the present invention will be described with reference to FIG. 12.

Figure 12:
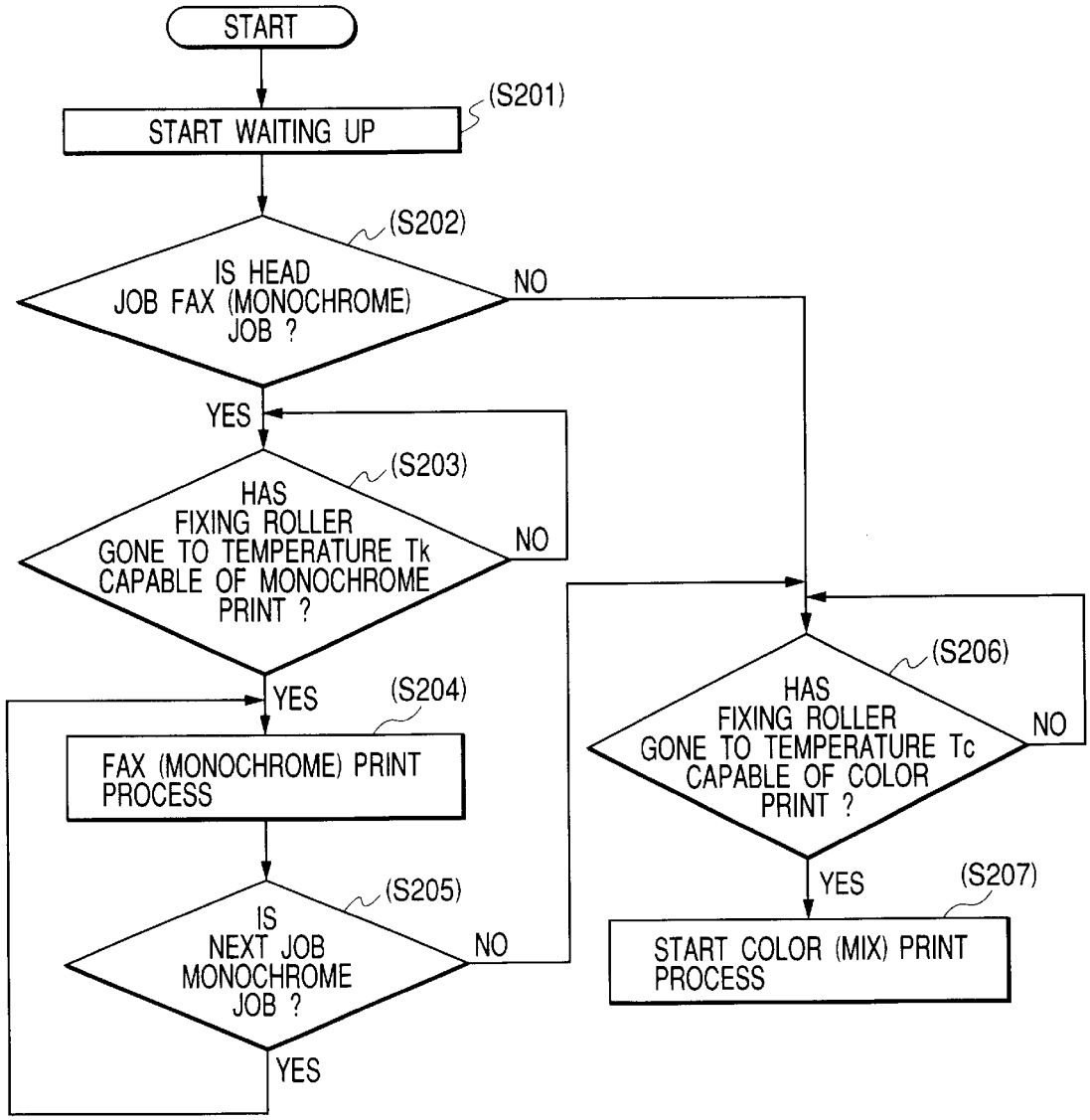
FIG. 12 is a flowchart showing an example of a second control processing procedure of the image forming apparatus of the present invention.

FIG. 12 is a flowchart showing an example of a second control processing procedure of the image forming apparatus of the present invention, and corresponds to a print processing procedure after waiting up. Note that the processing in this flowchart is realized by the CPU 401 shown in FIG. 10 based on a program stored in the ROM 405 or a storage medium (not shown). Also, reference symbols S201 to S207 respectively indicate Steps.

First, when waiting up is started in Step S201, it is judged whether the head job of the queue to be subjected to a print process is a FAX (or monochrome) job in Step S202. In the case where it has been judged that the head job of the queue is a FAX (or monochrome) job, the processing proceeds to Step S203 in which it is waited for the fixing roller to have gone to Tk that is a temperature capable of only monochrome print. When the fixing roller temperature has gone to Tk, the processing proceeds to Step S204 in which there is performed a FAX (monochrome) print process.

When the FAX (monochrome) print process is finished, the processing proceeds to Step S205 in which it is judged whether the next job is a monochrome job. In the case where it has been judged that the next job is a monochrome job, the processing returns to Step S204 in which there is performed a print process in order to print a FAX job or a monochrome job.

On the other hand, in the case where it has not been judged that the next job is a monochrome job in Step S205, the processing proceeds to Step S206 in which the processing is suspended to wait for the fixing roller to have gone to Tc that is a temperature capable of color print. When the fixing roller has gone to Tc, the processing proceeds to Step S207 in which a color (mix) print process is started.

On the other hand, in the case where it has not been judged that the head job of the queue is a FAX (monochrome) job in Step S202, the processing proceeds to Step S206 in which the processing is suspended until the fixing roller has gone to Tc that is the temperature capable of color print. When the fixing roller temperature has gone to Tc, the processing proceeds to Step S207 in which a color (mix) print process is started.

It should be noted here that in the above description, in the case where it has not been judged that the next job is a monochrome job in Step S205, the print process is immediately suspended and is resumed when the temperature of the fixing roller reaches Tc that is the temperature capable of color print. However, there may be obtained a construction where in the case where it has been found that the next job is not a monochrome job but is a mix job whose first page is a monochrome page in Step S205, only the monochrome pages that are successively arranged from the first page are first printed. Then, the processing proceeds to Step S206 in which the print process is suspended until the temperature of the fixing roller reaches Tc.

As has been described above, in the case where the network printer 102 is a multifunction copying machine having copy, print, and FAX functions, with reference to the color modes of queued jobs, an output operation is started immediately after the temperature of the fixing roller reaches a temperature capable of monochrome job print after a power supply is turned on or after the low-power mode is released. By doing so, it becomes possible to substantially shorten a waiting time until a print process is completed in the case where a printer is in a usage condition where a usage frequency is relatively low, the returning from the low-power mode is frequently performed, and relatively many monochrome jobs are processed.

As a result of the processing described above, the image forming apparatus of the present invention changes the print start temperature after warm-up with reference to the color mode of the queued head job at the time of returning from the low-power consumption mode (the print start temperature is set at Tk that is a temperature corresponding to the monochrome print mode in the case where the head job is a monochrome job, while the print start temperature is set at Tc that is a temperature corresponding to the color print mode in the case where the head job is a color job (or mix job)). Note that even if the head job is a monochrome job, in the case where two jobs in the head of the queue are demanded by the same user and are successively queued in the order of a monochrome job and a color job, the print jobs are started after the fixation standby temperature reaches Tc that is a temperature corresponding to the color print mode. In other cases (cases where two jobs from the same user are not successively queued in the order of a monochrome job and a color job in the head of the queue at the time of returning from the low-power consumption mode), the print jobs are started after the fixation standby temperature reaches a temperature corresponding to the color mode of the job queued as the head job (after the fixation standby temperature reaches Tk in the case where the head job is a monochrome job, and after the fixation standby temperature reaches Tc in the case where the head job is a color (mix) job).

By doing so, it becomes possible to shorten a time required to process the first job after the returning from the low-power mode or the like. In particular, in the case where two jobs in the head of the queue are demanded by the same user and are successively queued in the order of a monochrome job and a color job, it is possible to shorten a time required to process the first user's job. Also, the present invention is, in particular, effective in the case where an image forming apparatus is in a circumstance where the inputting of print jobs is performed with low frequency and the returning from the low-power mode is frequently performed.

Further, the present invention is, in particular, effective in the case where an image forming apparatus is in a circumstance where the inputting of print jobs is performed with low frequency and the returning from the low-power consumption mode is frequently performed for FAX print.

Accordingly, in the case where a printer is in a usage condition where a usage frequency is relatively low, the releasing from the low-power mode is frequently performed, and relatively many monochrome jobs are processed, it becomes possible to substantially shorten a waiting time until a print process is completed.

It should be noted here that each of the aforementioned embodiments has been described by taking, as an example, a case where the printer portion (printer engine) adopts a laser beam process, although the present invention is applicable even to a case where the printer portion adopts an electrophotographic process (LED process, for instance) in place of the laser beam process.

Also, a construction where the embodiments described above are combined with each other is included in the present invention.

Hereinafter, constructions of data processing programs readable by the image forming apparatus according to the present invention will be described with reference to a memory map shown in FIG. 13.

FIG. 13 illustrates a memory map of a storage medium in which there are stored various kinds of data processing programs that are readable by the image forming apparatus according to the present invention.

It should be noted here that, although not specifically illustrated, there is a case where there are also stored information for managing a group of programs stored in the storage medium (version information, information showing creators of the programs, and the like, for instance), information depending on the OS or the like on a program reading side (icons for distinguishably displaying the programs, for instance), and the like.

Further, data belonging to various kinds of programs is also managed in a directory. Also, in the case where a program or data to be installed is compressed, there may be a case where there is also stored a program for decompressing it or the like.

The functions in this embodiment shown in FIGS. 8 and 12 may be realized by a host computer based on a program installed from the outside. Also, in this case, the present invention is applied even to a case where information group including the program is supplied to an output apparatus from a storage medium (such as a CD-ROM, a flash memory, or a FD) or from an external storage medium over a network.

Needless to say, the object of the present invention is also attained even if a storage medium that records a program code of software for realizing the functions described in the aforementioned embodiments is supplied to a system or an apparatus in the manner described above and a computer (CPU or MPU) of the system or apparatus reads and executes the program code stored in the storage medium.

In this case, the program code itself read from the storage medium realizes the novel functions of the present invention, which means that the storage medium storing the program code constitutes the present invention.

As the storage medium for supplying the program code, it is possible to use a floppy (trademark) disk, a hard disk, an optical disk, a magneto-optical disk, a CD-ROM, a CD-R, a DVD-ROM, a magnetic tape, a nonvolatile memory card, a ROM, an EEPROM, a silicon disk, or the like, for instance.

Also, needless to say, in addition to the case where the functions described in the aforementioned embodiments are realized by the execution of the read program code by the computer, the present invention includes a case where an OS (operating system) or the like running on the computer performs all or a part of actual processing based on instructions of the program code and the functions in the embodiments described above are realized by such processings.

Further, needless to say, the present invention includes a case where the program code read from the storage medium is written in a memory provided on a function expansion board inserted into a computer or a function expansion unit connected to the computer, thereafter a CPU or the like of the function expansion board or the function expansion unit performs all or a part of actual processing based on instructions of the program code, and the functions in the embodiments described above are realized by such processings.

Also, it does not matter whether the present invention is applied to a system constructed from a plurality of devices or to an apparatus composed of a single device. Also, needless to say, the present invention is also applicable to a case where the aforementioned functions are realized by supplying a program to a system or an apparatus. In this case, the system or apparatus reads a storage medium, in which there is stored a program expressed by software for attaining the present invention, and enjoys the effects of the present invention.

Further, by downloading and reading the program expressed by the software for attaining the present invention from a database on a network using a communication program, it becomes possible for the system or apparatus to enjoy the effects of the present invention.

As described above, at the time of returning from the low-power mode that is set to interrupt the electrical energization of a fixing unit because a state where no print process is performed continues for a predetermined time, the print start temperature of the fixing unit is determined (changed) based on the print mode of a job to be processed first. This makes it possible to shorten a time required to process the first job after the returning from the low-power mode or the like. In particular, the present invention is effective under an image forming circumstance where the inputting of print jobs is performed with low frequency so that the transition to the low-power mode is frequently performed and the returning from the low-power mode is also frequently performed. Also, the present invention is effective under an image forming circumstance where the inputting of print jobs is performed with low frequency so that the transition to the low-power mode is frequently performed and the returning from the low-power consumption mode is also frequently performed in order to perform FAX printing.

Accordingly, the present invention achieves various effects. For instance, under a usage condition where a usage frequency is relatively low and the, releasing from the low-power mode is frequently performed and under an image forming circumstance where relatively many monochrome jobs are processed, it becomes possible to substantially shorten a waiting time until a print process is completed.

What is claimed is:

1. An image forming apparatus comprising:

a fixing unit that performs thermal fixation for a sheet on which a developer has been transferred; and a controller that sets a temperature of the fixing unit selectively at between a first temperature for fixing a developer expressing a monochrome image on a sheet and a second temperature for fixing developers expressing a color image on a sheet, wherein the controller sets the temperature of the fixing unit at the second temperature if a color page is contained in an image forming job, and the controller starts the image forming job, and wherein even if a head page of the image forming job is a monochrome page, the controller sets the temperature of the fixing unit at the second temperature if a color page is contained in the image forming job, and the controller starts the image forming job.

2. An image forming apparatus according to claim 1, wherein the controller sets the temperature of the fixing unit at the first temperature if a color page is not contained in the image forming job, and the controller starts the image forming job.

3. An image forming apparatus according to claim 1, wherein if a color page is not contained in a preceding image forming job and if a head page of a succeeding image forming job that contains a color page is a monochrome page, the controller sets the temperature of the fixing unit at the first temperature and starts the succeeding image forming job.

4. An image forming apparatus according to claim 3, wherein prior to image formation for a first color page of the succeeding image forming job, the controller sets the temperature of the fixing unit at the second temperature.

5. An image forming apparatus comprising:

a fixing unit that performs thermal fixation for a sheet on which a developer has been transferred; and a controller that sets a temperature of the fixing unit selectively at between a first temperature for fixing a developer expressing a monochrome image on a sheet and a second temperature for fixing developers expressing a color image on a sheet, wherein the controller sets the temperature of the fixing unit at the second temperature if a color page is contained in an image forming job, and the controller starts the image forming job, wherein the controller sets the temperature of the fixing unit at the first temperature if an image forming job that does not contain a color page is received under a state where a low-power consumption mode is set, and wherein the controller sets the temperature of the fixing unit at the second temperature if an image forming job that contains a color page is received under the state where the low-power consumption mode is set.

6. An image forming apparatus according to claim 5, wherein the controller sets the temperature of the fixing unit at the first temperature if a color page is not contained in a first image forming job among a plurality of image forming jobs received under the state where the low-power consumption mode is set, and the controller sets the temperature of the fixing unit at the second temperature if a color page is contained in the first image forming job among the plurality of image forming jobs received under the state where the low-power consumption mode is set.

7. An image forming apparatus comprising:

a fixing unit that performs thermal fixation for a sheet on which a developer has been transferred; and a controller that sets a temperature of the fixing unit selectively at between a first temperature for fixing a developer expressing a monochrome image on a sheet and a second temperature for fixing developers expressing a color image on a sheet, wherein the controller sets the temperature of the fixing unit at the second temperature if a color page is contained in an image forming job, and the controller starts the image forming job, and wherein if a color page is contained in a succeeding image forming job, the controller sets the temperature of the fixing unit at the second temperature even if a color page is not contained in the image forming job.

8. An image forming apparatus according to claim 7, wherein the controller sets the temperature of the fixing unit at the first temperature if a color page is not contained in a plurality of image forming jobs received under a state where a low-power consumption mode is set, and the controller sets the temperature of the fixing unit at the second temperature if a color page is contained in any one among the plurality of image forming jobs received under the state where the low-power consumption mode is set.

* * * * *

UNITED STATES PATENT AND TRADEMARK OFFICE

CERTIFICATE OF CORRECTION

PATENT NO. : 6,751,425 B2
DATED : June 15, 2004
INVENTOR(S) : Takashi Fujimori et al.

It is certified that error appears in the above-identified patent and that said Letters Patent is hereby corrected as shown below:

Column 3,
Line 16, “arrive” should read -- arrive at --.

Column 9,
Line 30, “of” (2nd occurrence) should be deleted.
Line 56, “on the midway of” should read -- midway through --.

Column 11,
Line 64, “is waited” should read -- waits --.

Column 12,
Lines 8 and 17, “is waited” should read -- waits --.

Column 14,
Line 45, “is waited” should read -- waits --.

Signed and Sealed this

Seventh Day of September, 2004

JON W. DUDAS
*Director of the United States Patent and Trademark Office*